US010117796B2

(12) United States Patent
Koshido et al.

(10) Patent No.: US 10,117,796 B2
(45) Date of Patent: Nov. 6, 2018

(54) HAND RIM

(71) Applicants: HONDA MOTOR CO., LTD., Tokyo (JP); HONDA R&D SUN CO., LTD., Hayami-gun, Oita (JP)

(72) Inventors: Akihiko Koshido, Saitama (JP); Takayuki Nodomi, Saitama (JP); Junji Takado, Saitama (JP); Norifumi Naono, Oita (JP)

(73) Assignees: HONDA MOTOR CO., LTD., Tokyo (JP); HONDA R&D SUN CO., LTD., Hayami-Gun (JP)

( * ) Notice: Subject to any disclaimer, the term of this patent is extended or adjusted under 35 U.S.C. 154(b) by 0 days.

(21) Appl. No.: 15/413,126

(22) Filed: Jan. 23, 2017

(65) Prior Publication Data

US 2017/0304131 A1 Oct. 26, 2017

(30) Foreign Application Priority Data

Apr. 21, 2016 (JP) ..... 2016-085089

(51) Int. Cl.
*A61G 5/02* (2006.01)

(52) U.S. Cl.
CPC ..... *A61G 5/022* (2013.01); *A61G 5/028* (2013.01)

(58) Field of Classification Search
CPC ..... A63G 5/028; A63G 5/027; A63G 5/02; A63G 2005/1054; A61B 49/08; A61G 5/028; A61G 5/027; A61G 5/02; A61G 5/022; A63B 49/08
USPC ..... 280/250.1, 304.1; 74/558, 551.9; 16/421; 152/210, 212
See application file for complete search history.

(56) References Cited

U.S. PATENT DOCUMENTS 841,204 A * 1/1907 Whitcomb ..... F21V 19/06 431/113
2,446,622 A * 8/1948 Turner ..... C14B 1/00 16/421
2,984,486 A * 5/1961 Jones ..... A63B 59/70 16/421
4,366,964 A * 1/1983 Farey ..... A61G 5/02 280/250.1
5,049,598 A * 9/1991 Saito ..... B60C 1/0016 152/209.4
5,603,367 A * 2/1997 Watanabe ..... B29C 70/58 152/209.4
6,651,526 B1 * 11/2003 Imaizumi ..... B62D 1/06 74/552
2004/0103745 A1 * 6/2004 Willems ..... A61G 5/02 74/552
2011/0119868 A1 * 5/2011 LaLonde ..... B25G 1/102 16/421
2016/0242976 A1 * 8/2016 Daigle ..... A61G 5/022

FOREIGN PATENT DOCUMENTS

JP 2006-305006 11/2006

* cited by examiner

*Primary Examiner* — Anne Marie M Boehler
(74) *Attorney, Agent, or Firm* — Rankin, Hill & Clark LLP

(57) ABSTRACT

Provided is a hand rim which is not slippery even when the surface is wet. A hand rim 7 includes a base material 70 and an anti-slippage layer 71 formed on the surface of the base material 70. The anti-slippage layer 71 includes an adhesive layer 71*a* formed on the surface of the base material 70 and particles 71*b* which are fixed through the adhesive layer 71*a*. The particles 71*b* are fixed so as to protrude from the adhesive layer 71*a*.

4 Claims, 5 Drawing Sheets

HAND RIM

BACKGROUND OF THE INVENTION

Field of the Invention

The present invention relates to a hand rim for a wheelchair, especially a hand rim for a wheelchair for racing used for track race, marathon, or the like.

Description of the Related Art

Conventionally, as a hand rim for a wheelchair provided at a drive wheel of a wheelchair for racing, there is known a hand rim provided with an anti-slippage layer on a surface of a base material formed by fiber-reinforced resin material or metal. As this type of anti-slippage layer, there is known to form the anti-slippage layer by winding a tape, a tube, or a code to the base material (for example, refer to Patent Literature 1: Japanese Patent Laid-open No. 2006-305006).

SUMMARY OF THE INVENTION

Problems to be Solved by the Invention

However, since the tapes, tubes, or codes used in such a conventional hand rim as disclosed in Patent Literature 1 are formed by materials such as rubber material or the like, there is a problem that the hand rim is slippery in a case the surface gets wet by rain or sweat, and there is water existing on the contact surface with the hands (glove).

The present invention has been made in view of the above, and it is an object of the present invention to provide a hand rim which does not become slippery even if the surface is wet.

Solution to the Problem

In order to achieve the above object, a hand rim of the present invention is a hand rim for a wheelchair provided at a drive wheel including: an annular base material, and an anti-slippage layer formed on a surface of the base material, wherein the anti-slippage layer includes an adhesive layer formed on the surface of the base material and particles fixed through the adhesive layer, and wherein the particles are fixed so as to protrude from the adhesive layer.

As such, in the hand rim of the present invention, the particles are fixed so as to protrude from the adhesive layer of the anti-slippage layer. Therefore, a plurality of concaves and convexes exist on the surface of the hand rim, thereby maintaining a state of high friction resistance against the hand (glove) of the user even in a wet state. Therefore, the hand rim of the present invention does not become slippery even if the surface is wet.

Moreover, it is preferable in the hand rim of the present invention that a thickness of the adhesive layer is equal to or less than a half of an average particle diameter of the particles. According to such configuration, sufficient roughness (concaves and convexes) is formed by the particles, thereby becoming easy to obtain sufficient friction resistance. Moreover, since it is able to reduce the amount of adhesive agent forming the adhesive layer, the manufacturing cost can be suppressed.

Moreover, it is preferable in the hand rim of the present invention that the anti-slippage layer is formed on a peripheral surface of the base material in a region of an opposite side of a wheel when attached to the wheel and in a region of inner peripheral side.

Since the anti-slippage layer is formed in order to increase the friction resistance against the hand of the user, it only needs to be formed at least in the region which the hands of the user contact. In this regard, by forming the anti-slippage layer at the above regions, the amount of particles required for forming the anti-slippage layer can be suppressed, thereby enabling to suppress the manufacturing cost without decreasing the friction resistance.

Moreover, it is preferable in the hand rim of the present invention that the particles are plant-based particles, and wherein a content of oil and fat in the particles is equal to or less than 0.4%. When the oil and fat is 0.4% or less, it is able to increase the adhesive property with respect to the adhesive layer.

Moreover, it may be configured in the hand rim of the present invention that an occupancy area of a region in which the particles exist with respect to a surface of the anti-slippage layer is equal to or more than 80%.

DESCRIPTION OF THE PREFERRED EMBODIMENTS

Hereinafter, the configuration of a wheelchair W according to an embodiment will be explained with reference to the drawings. The wheelchair W is a wheelchair used for track race, marathon, or the like.

First, referring to FIG. 1 to FIG. 3, the schematic configuration of the wheelchair W will be explained.

Figure 1:
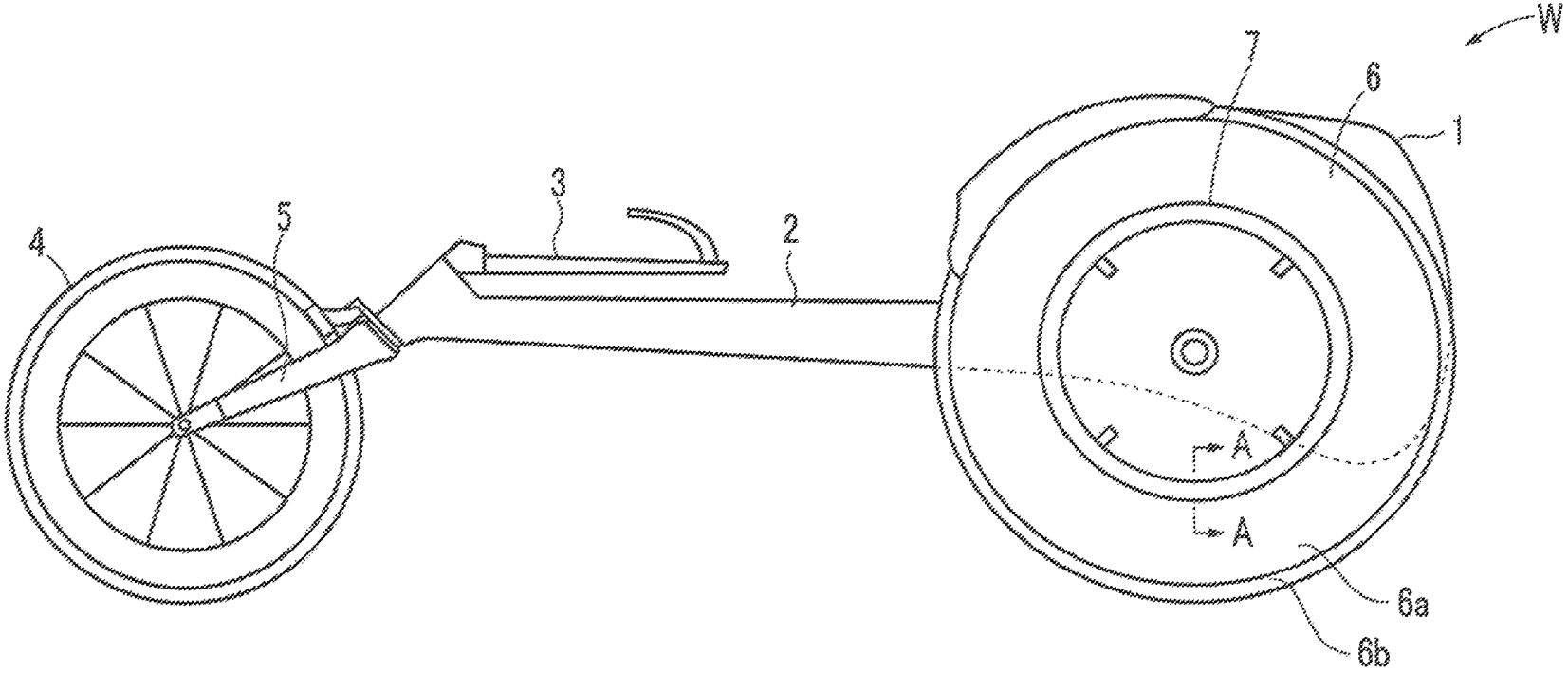
FIG. 1 is a side view illustrating a wheelchair according to an embodiment of the present invention.

As shown in FIG. 1, the wheelchair W includes a cage 1, a vehicle body frame 2 extending forward of the cage 1, a steering handle 3 provided at the vehicle body frame 2, a front wheel 4 arranged at a forward end portion of the vehicle body frame 2, a front fork 5 attached to the forward end portion of the vehicle body frame 2 and to which the handle 3 is connected and which holds the front wheel 4, a pair of rear wheels 6 attached to right and left of the cage 1, and a hand rim 7 attached to the rear wheel 6 at the opposite side of the cage 1.

Figure 2:
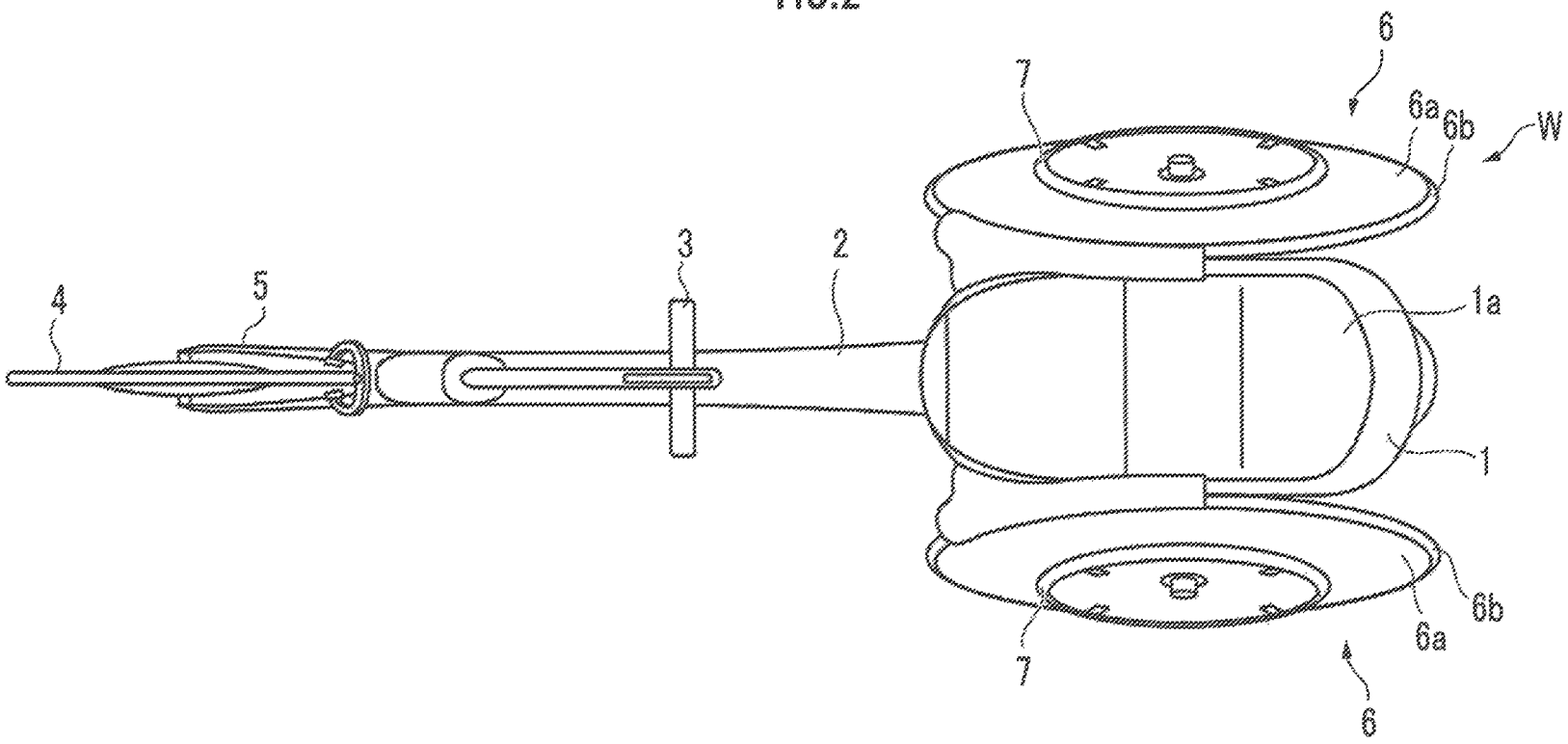
FIG. 2 is a plane view of the wheelchair of FIG. 1.

As shown in FIG. 2, the cage 1 is opened at the upper part and a sitting seat 1*a* on which the player sits on is arranged inside the cage 1.

Figure 3:
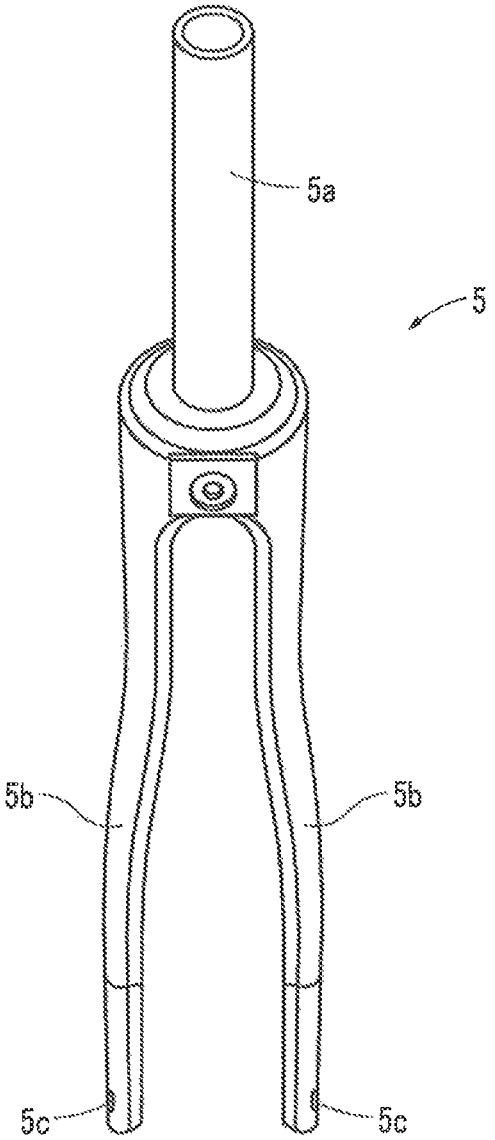
FIG. 3 is a plane view of a front fork of the wheelchair of FIG. 1.

The handle 3 is connected to the end portion of the column 5*a* of the front fork 5 prefer to FIG. 3) pivotally supported by the end portion of the vehicle body frame 2. In the wheelchair W, by operating the handle 3, the orientation of the front wheel 4 is changed via the front fork 5, and the wheelchair W is able to be turned to travel in a desired direction.

The rear wheel 6 is configured by a wheel 6*a* and a tire 6*b* fitted to the wheel 6*a*. The rear wheel 6 is attached to the cage 1 in a state inclined such that the upper side of the rear wheel 6 approaches more to the center side of the cage 1.

The hand rim 7 is fixed such that it is able to integrally rotate with the rear wheel 6. The player seated on the sitting seat 1*a* transmits the driving force to the rear wheel 6 through the hand rim 7.

As shown in FIG. 3, the front fork 5 includes a column 5*a* supported at the end portion of the vehicle body frame 2 and a fork portion 5*b* which extends forward to bifurcate from the column 5*a*. A bearing hole 5*c* which supports the axle of the front wheel 4 is formed at the end portion of the fork portion 5*b*.

The column 5*a* is cylindrically formed and is pivotally supported by the forward end portion of the vehicle body frame 2 via a bearing (not illustrated). Handle 3 (refer to FIG. 1) is fixedly provided at the upper end portion of the column 5*a*.

Figure 4:
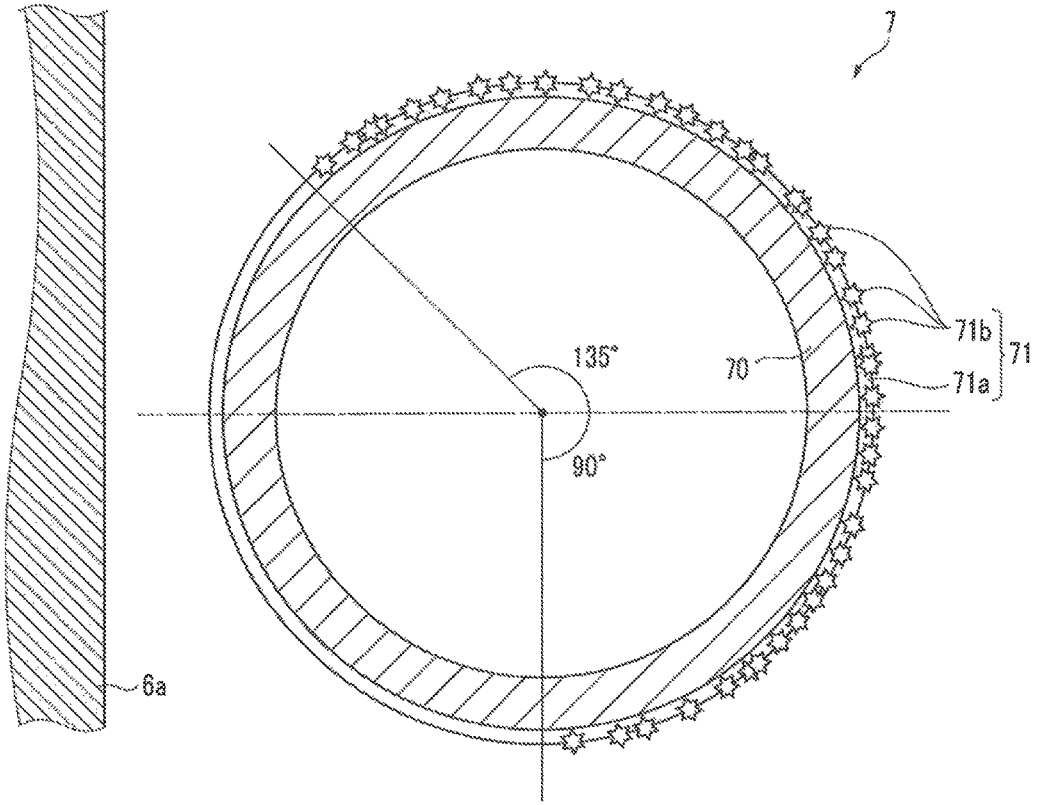
FIG. 4 is an A-A line cross sectional view of a hand rim of the wheelchair of FIG. 1.

Next, with reference to FIG. 1 and FIG. 4, a hand rim 7 is explained in details.

As shown in FIG. 4, the hand rim 7 includes a hollow annular base material 70 and an anti-slippage layer 71 formed on the surface of the base material 70.

The base material 70 is annularly formed by connecting a plurality of pipes formed by laminating fiber-reinforced plastics using a boss made of metal such as aluminum, iron, or the like (refer to FIG. 1). The hand rim 7 configured as above is fixed to a surface of the wheel 6*a* of the rear wheel 6 as the drive wheel on a side opposite to the cage 1 by a screw (not illustrated) which pierces the boss.

Here, the hand rim of the present invention may be attached to the front wheel depending on the structure of the wheelchair, since it only requires to be fixed to the drive wheel which is driven by the user.

As the fiber-reinforced plastic forming the base material 70, for example, fiber-reinforced plastic using polyacrylonitrile (PAN)-based carbon fiber, aramid fiber-reinforced plastic, or fiber-reinforced plastic or the like reinforced by glass fiber, pitch-based carbon fiber, PBO fiber, polyarylate fiber, or polyethylene fiber.

The base material 70 does not necessarily have to be formed by connecting the plurality of pipes formed by fiber-reinforced plastic by a boss. For example, instead of fiber-reinforced plastic, the pipe may be formed by metal. Moreover, instead of forming the base material by connecting the plurality of pipes by the boss, the base material may be integrally formed without using a boss. Moreover, the cross sectional shape of the base material may be a rectangular tubular shape or a solid columnar shape instead of a cylindrical shape.

The anti-slippage layer 71 includes an adhesive layer 71*a* formed on the surface of the base material 70 and particles 71*b* fixed through the adhesive layer 71*a*.

The anti-slippage layer 71 is formed on a peripheral surface of the base material 70 in a region which becomes the opposite side of the wheel 6*a* when attached to the wheel 6*a* and in a region of the inner peripheral side. More specifically, when a line orthogonal to the surface of the wheel 6*a* being a reference line, the anti-slippage layer 71 is formed in a range of 135° to the inner peripheral side and 90° to the outer peripheral side.

This is because the anti-slippage layer 71 is formed to increase the friction resistance against the user's hand, it only needs to be formed at least in a region in which the hands of the user contact. By limiting the range of forming the anti-slippage layer 71 as such in the hand rim 7, the amount of particles 71*b* required for forming the anti-slippage layer 71 is suppressed, thereby suppressing the manufacturing cost, without decreasing the friction resistance.

The region for forming the anti-slippage layer 71 is not limited to the above regions, and may be appropriately changed according to the size of the hand of the user, the amount of particles which can be used, or the like. For example, the anti-slippage layer 71 may be formed across the whole region of the peripheral surface of the base material 70.

The adhesive layer 71*a* is formed of thermosetting resin such as epoxy, urethane, unsaturated polyester, vinyl ester resin, or the like.

Figure 5:
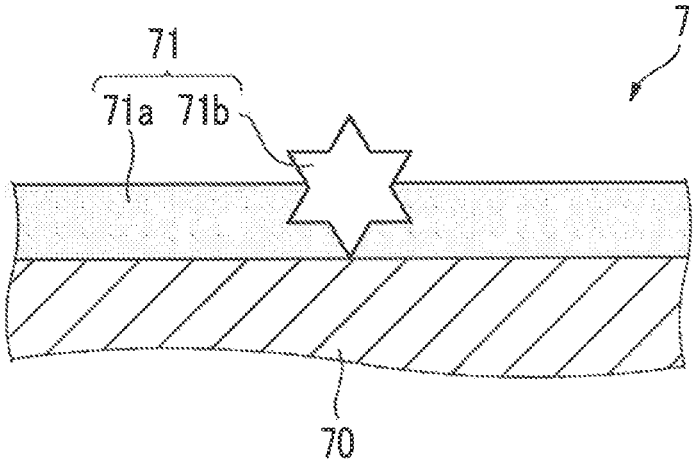
FIG. 5 is a cross sectional view illustrating an enlarged configuration of an anti-slippage layer of the hand rim of the wheelchair of FIG. 1

The particles 71*b* have an average particle diameter of 200 μm to 300 μm, and are fixed such that at least a part of it protrudes from the adhesive layer 71*a*. More specifically, as shown in FIG. 5, it is configured that the thickness of the adhesive layer 71*a* is equal to or less than a half of the average particle diameter. Therefore, a plurality of concaves and convexes (roughness) exist on the surface of the hand rim 7. As a result, even in a wet state, a state of high friction resistance with the user's hands (glove) is maintained.

Moreover, the particles 71*b* are plant-based particles, and those having oil and fat of 0.07% are used. More specifically, grained seeds and shells of peach, nut, apricot, or the like are used. This is, in order to improve the adhesive property with respect to the adhesive layer 71*a*.

Here, the particles 71*b* are not limited to the plant-based particles having an average particle diameter of 200 μm to 300 μm and oil and fat of 0.07%. For example, if the oil and fat is 0.4% or less, sufficient adhesive property can be obtained. Moreover, the particle diameter may be any size projectable from the adhesive layer. Moreover, ceramic-based particles may be used instead of plant-based particles.

Moreover, sufficient friction resistance can be obtained if the particles 71*b* are fixed so as to protrude at least approximately 70 μm from the adhesive layer 71*a*. Therefore, the thickness of the adhesive layer may be appropriately changed according to the particle diameter of the particles or the performance of the adhesive agent forming the adhesive layer.

The occupancy area of the region where the particles 71*b* exist with respect to the surface of the anti-slippage layer 71 was measured at 5 points separate by even intervals on the hand rim 7. The occupancy area at each position was 96.46%, 95.68%, 97.37%, 96.61%, and 97.22%. Accordingly, since the occupancy areas are such values, the hand rim 7 is able to obtain appropriate friction resistance when the user drives the hand rim 7.

However, the occupancy area of the particles 71*b* on the surface of the anti-slippage layer 71 is not limited to the above values. The occupancy area may be appropriately changed according to the average particle diameter or the like of the particles 71*b*, or the required friction resistance or the like. It should be at least 80% or more. Especially, it is preferable that the occupancy area is over 95%.

The hand rim 7 is formed by coating the thermosetting resin forming the adhesive layer 71*a* on the base material 70 by a method such as brush, spray, or dip, and thereafter sprinkling the particles 71*b*. Then, heat treatment is performed to form the hand rim 7. The heat treatment can be omitted depending on the type of the thermosetting resin. Especially, when using plant-based particles as the particles 71*b*, resin which cures without performing heat treatment may be used.

The hand rim 7 may be formed using other methods. For example, thermosetting resin which is formed as a film in advance may be used as the adhesive layer 71*a*. Moreover, a thermosetting resin in which the particles 71*b* are mixed therein may be coated to form the adhesive layer 71*a*, and at the same time fixing the particles 71*b*.

Although the above explains the illustrated embodiment, the present invention is not limited to such mode.

For example, in the embodiment, the anti-slippage layer 71 is formed in the entire region of the surface of the hand rim 7. However, the anti-slippage layer may be formed only on a part of the hand rim. For example, the anti-slippage layer 71 may be formed only in a region of the hand rim on an opposite side of the surface of the rear wheel or only in a region on the outer peripheral side of the hand rim. Moreover, a portion formed with the anti-slippage layer and a portion not formed with the anti-slippage layer may be arranged alternately to form a stripe pattern.

EXPLANATION OF REFERENCE SIGNS

1 . . . cage, 1*a* . . . sitting seat, 2 . . . vehicle body frame, 3 . . . handle, 4 . . . front wheel, 5 . . . front fork, 5*a* . . . column, 5*b* . . . fork portion, 5*c* . . . bearing hole, 6 . . . rear wheel, 6*a* . . . wheel, 6*b* . . . tire, 7 . . . hand rim, 70 . . . base material, 71 anti-slippage layer, 71*a* . . . adhesive layer, 71*b* . . . particle, W . . . wheelchair

What is claimed is:

1. A hand rim for a wheelchair provided at a drive wheel comprising:

an annular base material, and an anti-slippage layer formed on a surface of the base material, wherein the anti-slippage layer includes an adhesive layer formed on the surface of the base material and particles fixed through the adhesive layer, wherein the particles are fixed so as to protrude from the adhesive layer, and wherein a thickness of the adhesive layer is equal to or less than a half of an average particle diameter of the particles.

2. The hand rim according to claim 1, wherein the anti-slippage layer is formed on a peripheral surface of the base material only in a region which is an opposite side of the drive wheel when being attached to the drive wheel and in a region of inner peripheral side.

3. The hand rim according to claim 1, wherein the particles are plant-based particles, and wherein a content of oil and fat in the particles is equal to or less than 0.4%.

4. The hand rim according to claim 1, wherein an occupancy area of a region in which the particles exist with respect to a surface of the anti-slippage layer is equal to or more than 80%.

* * * * *